United States Patent [19]

Cole et al.

[11] 3,989,112

[45] Nov. 2, 1976

[54] MOTOR GRADER DRAWBAR ASSEMBLY WITH FLUID-OPERATED CYLINDERS FOR RESTRAINING CIRCLE GEAR

[75] Inventors: Carroll R. Cole; Gene B. Easterling, both of Decatur, Ill.

[73] Assignee: Caterpillar Tractor Co., Peoria, Ill.

[22] Filed: July 9, 1975

[21] Appl. No.: 594,397

[52] U.S. Cl. ..... 172/796; 91/44; 91/45; 172/742; 188/74; 192/3 N

[51] Int. Cl.² ..... E02F 3/85

[58] Field of Search ..... 172/741, 742, 791, 792, 172/793, 794, 795, 796, 797; 192/3 N, 8 R, 186; 188/74, 353, 365; 91/44, 45

[56] References Cited

UNITED STATES PATENTS

| | | | |
|---|---|---|---|
| 2,089,730 | 8/1937 | Brown et al. | 172/796 |
| 2,928,381 | 3/1960 | MacDonald | 91/186 |
| 3,593,806 | 7/1971 | Gurries | 172/741 |
| 3,712,384 | 1/1973 | Fisher | 172/796 |
| 3,819,018 | 6/1974 | Muller et al. | 192/8 R |

FOREIGN PATENTS OR APPLICATIONS

| | | | |
|---|---|---|---|
| 1,915,565 | 10/1970 | Germany | 188/365 |

*Primary Examiner*—Richard T. Stouffer
*Attorney, Agent, or Firm*—Robert E. Muir

[57] ABSTRACT

The motor grader drawbar assembly has a blade mounted on a circle gear and a drive unit operatively connected to the circle gear to selectively rotate it and the blade. A plurality of radially mounted pistons operate against an upright wall of the circle gear to provide a brake and/or locking mechanism. The pistons, and their accompanying cylinders, are mounted in members which also underlie and support the circle gear. Thus, the vertical position of the circle gear is not affected by the braking operation. A hydraulic circuit is provided to alternately operate the drive unit and the braking operation.

7 Claims, 6 Drawing Figures

Fig-1-
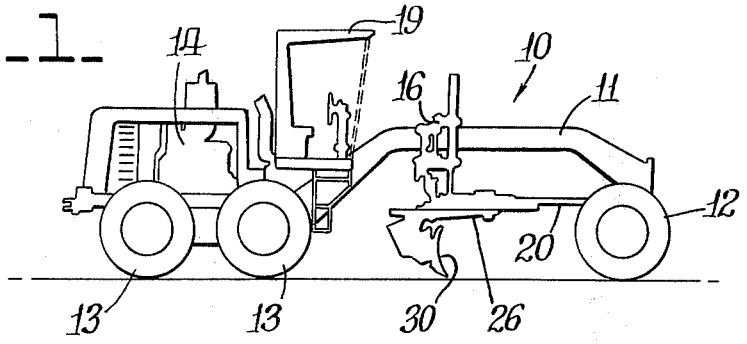
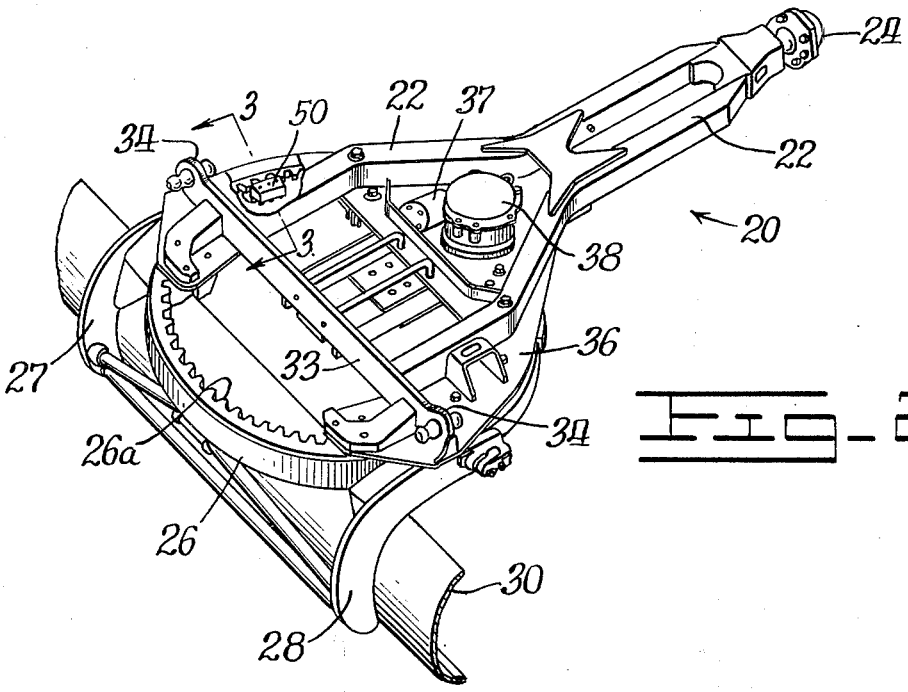
Fig-2-
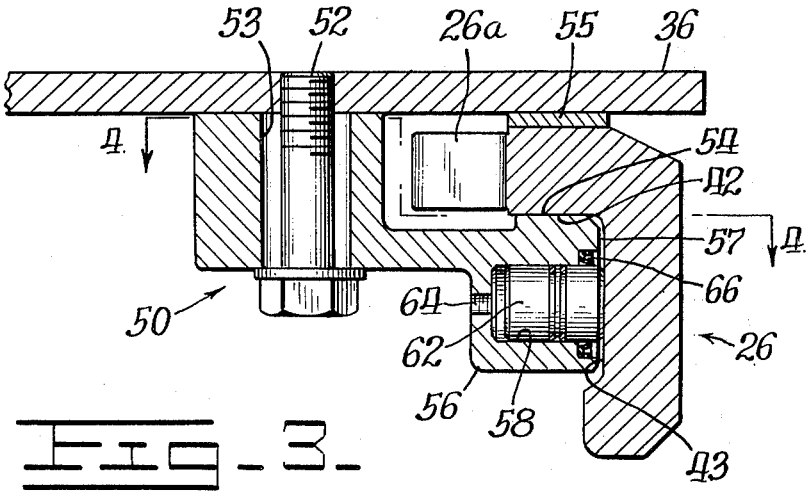
Fig-3-

MOTOR GRADER DRAWBAR ASSEMBLY WITH FLUID-OPERATED CYLINDERS FOR RESTRAINING CIRCLE GEAR

BACKGROUND

The invention pertains generally to earthworking equipment and more particularly to such equipment in which the working implement is selectively held in different positions with respect to the frame.

It is known that the working implement of various earthworking equipment must be adjusted to meet the requirements of a particular job. For example, in the case of a motor grader, the blade or moldboard is conventionally mounted for a variety of adjustments relative to the frame. The blade is mounted for elevational adjustment, cross slope adjustment, lateral sliding adjustment, and rotational adjustment. Conventionally, the rotational adjustment is achieved by the turning of a "circle gear" in the form of a ring-like structure slidably supported for rotary movement. It will be appreciated that the fit between a circle gear and its bearing support must be loose enough to permit such sliding movement and, as a consequence, a certain amount of wear will occur during the movement of a circle gear. Preferably, the circle gear is locked in position when it is not being rotated to prevent stress in the drive train thereto. Prior art locks or brakes have applied an upward force on the circle gear, thereby raising the blade a distance approximating the amount of wear or looseness.

Modern motor graders use an automatic blade control device for reading the desired grade level from a reference grade line or a wire and automatically adjusting the vertical positioning of the blade to maintain the reference level. However, such devices cannot compensate for changes in the vertical positioning of the blade due to wear in the mating surfaces of the blade support structure and any changes in the vertical positioning of the blade which may occur during adjustment of the angle of the blade with respect to the direction of motion of the motor grader will result in departures from the reference grade level. Since tolerances as small as one-eighth inch are now required in road grading operations, it will be seen that departures from the reference grade level during adjustment of the angle of the blade with respect to the direction of motion of the grader, or the working tolerances and wear inherent in the mounting structures which enable such adjustment of the blade, have made the above mentioned prior art devices unsuitable for such close tolerance work.

SUMMARY

The present invention relates to motor grader drawbar assemblies, and more particularly to a motor grader drawbar assembly having an improved brake or locking mechanism and/or support for the circle gear.

It is a general object of the present invention to provide a drawbar assembly with a circle brake or lock which overcomes vertical movement of the circle gear when the brake or lock is applied or released.

Another object is to provide a drawbar assembly in accordance with the foregoing object in which the brake or lock operates against a surface of the circle gear which is parallel to the axis thereof.

Still another object is to provide a mechanism in accordance with the foregoing object in which the brake or lock operates radially of the cirle gear.

Yet another object of the present invention is to provide a drawbar assembly with a circle brake or lock in which the support for the circle gear also serves as a mounting for the brake or lock mechanism.

These, and other objects and advantages of the present invention, will become apparent as the same becomes better understood from the following detailed description when taken in conjunction with the accompanying drawings.

DRAWINGS

FIG. 1 is a side elevation of a motor grader having a drawbar assembly thereon;

FIG. 2 is a perspective view of a drawbar assembly with a portion broken away for better illustration of the parts;

FIG. 3 is a cross-sectional view taken along line 3—3 of FIG. 2;

DESCRIPTION

Figure 4:
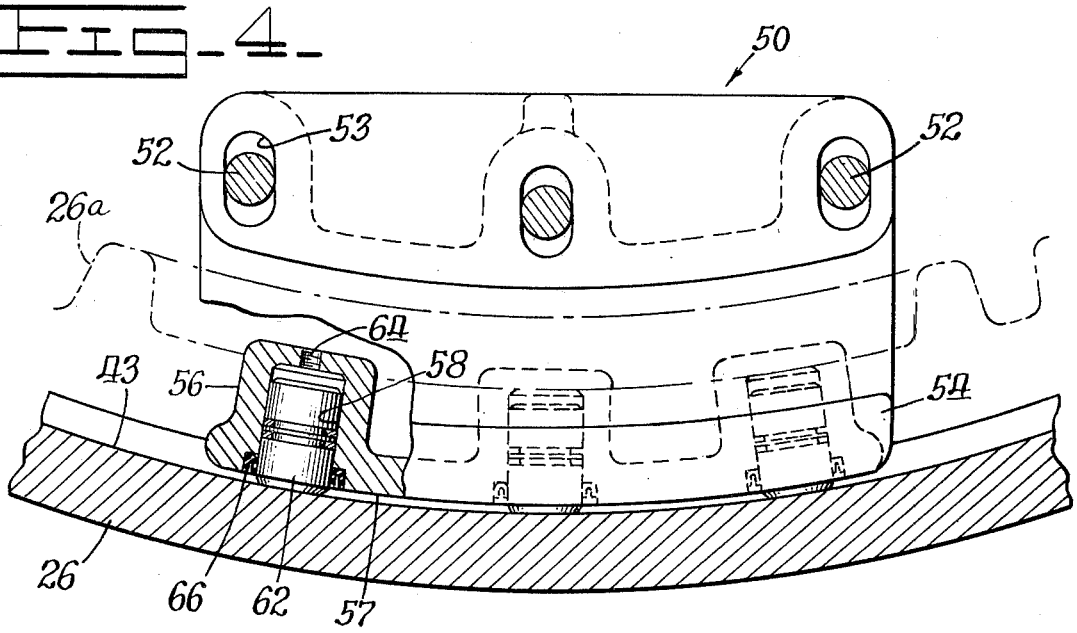
FIG. 4 is a sectional view taken generally along broken line 4—4 of FIG. 3.

Reference is now made more particularly to the drawings which illustrate the best presently known mode of carrying out the invention and wherein similar reference characters indicate the same parts throughout the several views.

The preferred embodiment of the present invention is shown in conjunction with a motor grader, generally designated 10, having an elongated arched frame 11 supported at the front end by a pair of steerable wheels 12 and at the rear end by one or more pairs of fixed driving wheels 13. An appropriate engine unit 14 is mounted on the frame 11 over the driving wheels 13 and supplies the mode of power for the motor grader as well as the power for operating the various control systems thereof, such as devices 16.

A drawbar assembly, generally designated 20 in FIG. 2, includes a Y-shaped drawbar frame 22 having a ball 24 at its forward end for pivotal connection to the motor grader 10. The other end of the drawbar structure 20 is mounted on the arched portion of the frame 11 by appropriate control devices such as hydraulic motors adapted to enable the drawbar 20 to be pivoted about the universal joint at the other end thereof with respect to the frame 11. As is usual, a circle 26 is rotatably mounted on the frame 22 and carries a pair of spaced supports 27 and 28 on which a moldboard or a blade 30 is mounted. Preferably, the blade 30 may be both tilted and shifted laterally relative to the circle 26. Appropriate controls for the operation thereof and other operations of the motor grader are located at an operator station 19 mounted on the frame 11 intermediate the engine unit 14 and the arched portion of the frame. The circle 26 has a plurality of teeth **26*a* on the inner surface to provide a means by which the circle may be rotated. Hence, the circle 26 is sometimes referred to as a circle gear. It will be understood that the blade and the circle are interconnected so that the blade 30 revolves as the circle 26** rotates.

Referring to FIG. 2, the Y-shaped frame 22 is shown as abutting a structural member 33 having projecting ends 34 which are provided with ball joint connecting means for attachment of the control devices 16 by which the free end of the drawbar structure 20 is mounted on the arched portion of the frame 11. A plate 36 may underlie a portion of the drawbar frame and serve as a convenient mounting platform for various components. A hydraulic motor 37 and its related gear train 38 may be mounted on the platform 36 to serve as a drive means for the circle gear 26.

Figure 6:
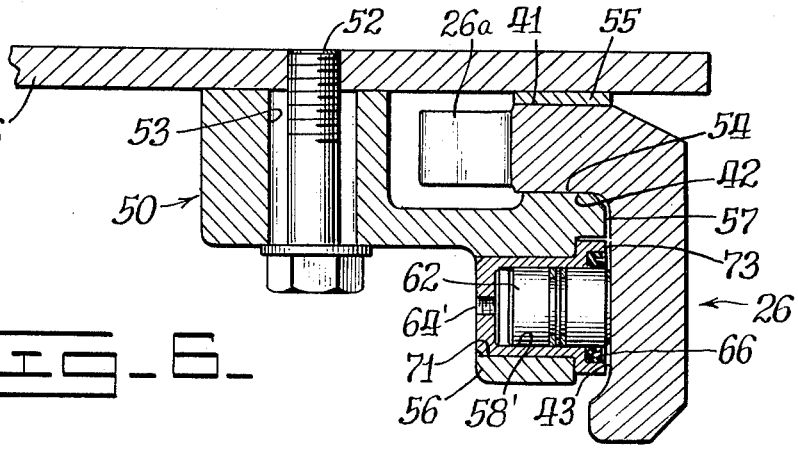
FIG. 6 is a view similar to FIG. 4 showing another embodiment.

Referring to FIGS. 3 and 6, it can be seen that the circle 26 has a cross section in the shape of an inverted L with the teeth forming an extension of the upper leg of the L and facing the axis of the circle. The upper leg has an upper bearing surface 41 and a lower bearing surface 42 providing a downwardly-facing land. The other leg advantageously has an inwardly-facing upright surface 43 outwardly of bearing surface 42 and defining a cylindrical surface parallel to the axis of the circle. A shoe, generally designated 50, is mounted on the platform 36 inwardly of the teeth 26*a* as by a plurality of bolts 52 passing through slotted openings 53 in the shoe. As can be seen, a portion of the shoe 50 extends adjacent the surface 43 and underlies bearing surface 42. The shoe has an upper bearing surface 54 which engages bearing surface 42 and holds the circle gear 26 mounted on the frame with bearing surface 41 adjacent a bearing 55. Preferably there are at least three of these shoes around the periphery of the circle gear 26.

In the FIG. 3 embodiment, shoe 50 has a plurality of depending bosses 56 and a face 57 adjacent circle gear cylindrical surface 43. A cylindrical chamber 58 is recessed in each boss 56 and intersects face 57. A movable wall in the form of a piston 62 is disposed in each chamber 58. A fluid port 64 communicates with the chamber rearwardly of the piston 62, and a seal 66 is provided in a circumjacent recess of the face 57.

In the FIG. 6 embodiment, the bosses 56 have a cylindrical opening 71 extending therethrough to receive a flanged insert 73. As can be seen from the drawing, the insert 73 provides a chamber 58′ and a port 64′ functionally similar to the FIG. 3 embodiment. Other parts, identical to those previously described, have been identified by the same numerals and further description is deemed unnecessary.

It is deemed apparent that either embodiment provides a plurality of chambers or cylinders 58 or 58′ mounted on the drawbar frame 11 at locations spaced circumferentially of the circle gear 26. The operating axis of each cylinder preferably extends radially of the circle gear or, in other words, extends normal to the cylindrical surface 43. In the embodiments shown, cylinders 58, 58′ are advantageously single-acting hydraulic cylinders, but double-acting cylinders may be used if desired.

Figure 5:
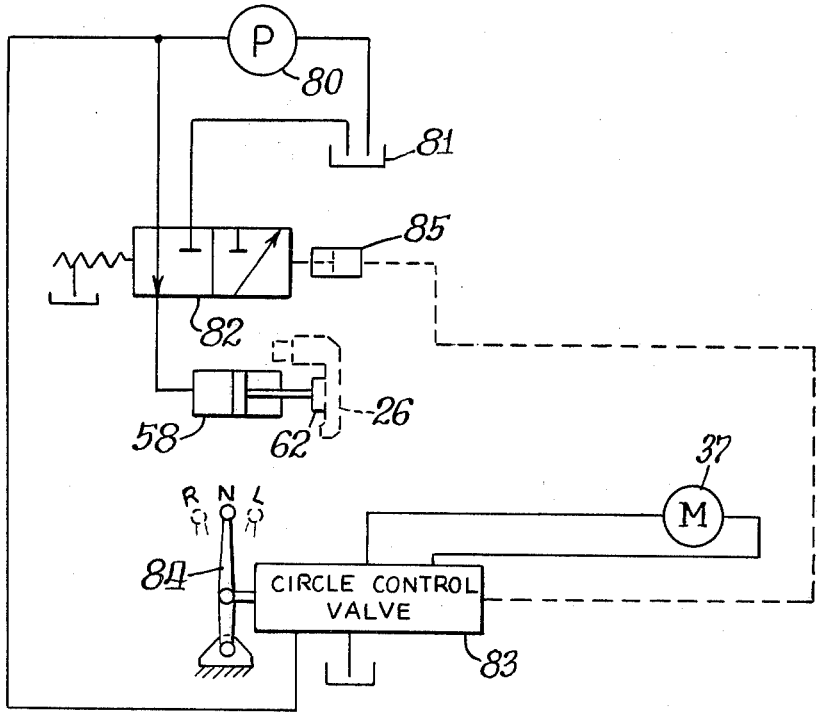
FIG. 5 is a diagrammatic view of one suitable hydraulic circuit usable in the present invention.

Referring to FIG. 5, a suitable control system is schematically illustrated. A hydraulic pump 80 which may be driven by the engine unit 14, pumps hydraulic fluid under pressure from a reservoir 81 both to a two-position control valve 82 and to a three-position control valve 83 operatively connected to the hydraulic motor 37 which drives the circle gear 26. In the position illustrated in FIG. 5, the control valve 82 directs hydraulic fluid under pressure from pump 80 to the cylinders 58 to thereby move the piston 62 against the circle 26 to lock the circle with respect to the drawbar frame 22, and the control valve 83 is shown in its neutral position in which the motor 37 is disconnected from the pressurized fluid provided by the pump 80.

A manually operated control lever 84 is mechanically connected to the slide member of the valve 83 so that movement of the control lever 84 in one direction L will actuate the motor 27 to rotate the circle 26 in one direction about its axis whereas movement of the control lever 84 in the opposite direction R will actuate the motor 37 to rotate the circle 26 in the opposite direction about its axis.

The control lever 84 is also connected to means for automatically moving the slide member of the two-position valve 82 to its opposite position whenever the control lever 84 is moved to actuate the motor 37 to rotate the circle 26 in either direction. As shown in the drawing, such means may comprise a pressure switch 85 operatively connected to valve 83 to receive pressure whenever the valve is in either position R or L, but not position N. Switch 85 is mechanically coupled to the slide member of the two-position valve 82. As shown, the slide member of the two-position valve 82 is spring-loaded to normally rest in the position shown. It will be understood that movement of the slide member of the valve 82 to its alternate position due to actuation of the switch 85 will close the application of pressure from the pump to hydraulic cylinders 58 to thereby terminate the pressure applied on the circle surface 43 by the piston 62.

The outer ends of pistons 62, namely the ends adjacent the surface 43, are advantageously made of lead. These lead pads provide a high coefficient of friction when operating against a surface that may be lubricated. This allows a substantial size reduction of the brake or lock assembly. The brake pads may be attached to the ends of the pistons 62 so they may be easily replaced. If desired, the pistons may have means to prevent them from rotating in the chamber or cylinder 58. Also if desired, a spring may be provided to retract the piston when the valve 82 is in its second or release position.

While preferred embodiments of the invention have herein been illustrated and described, this has been done by way of illustration and not limitation, and the invention should not be limited except as required by the scope of the appended claims.

What is claimed is:

1. In a drawbar assembly for use on a motor grader or the like including: a drawbar frame; a circle gear mounted on the frame for rotation about an axis; a working implement disposed generally crosswise of the circle gear axis; means interconnecting the implement and the circle gear; and drive means operative to rotate the circle gear and hence move the working implement; characterized by the circle gear having a generally smooth surface parallel to its axis and crosswise of the working implement; a plurality of fluid-operated cylinders each having a movable wall therein disposed adjacent said circle gear surface; mounting means for mounting the cylinders on the drawbar frame at locations spaced circumferentially of the circle gear; and means for selectively moving the cylinder walls between one position in frictional engagement with said circle gear surface to restrain the circle gear against movement and a second disengaged position removed therefrom; said frictional engagement providing a force in a direction which does not intersect the working implement and hence does not move the working implement when applied.

2. The combination of claim 1 wherein each cylinder has an operating axis and the mounting means mounts each cylinder with its operating axis extending radially of the circle gear.

3. The combination of claim 1 wherein the fluid-operated cylinders are hydraulic cylinders, the drive means includes a hydraulic motor for driving the circle gear, and the last-mentioned means includes a hydraulic circuit which incorporates controls which move the cylinder walls to said one position when the hydraulic motor is not operated and to the second position when the hydraulic motor is operated.

4. The combination of claim 1 wherein the circle gear has inwardly facing gear teeth, and the generally smooth surface is inwardly-facing and spaced radially outwardly of the gear teeth and depending therebelow to provide a downwardly-facing land between said surface and the gear teeth; wherein the mounting means includes at least one member secured to the drawbar frame inwardly of said surface, and said member having an upwardly-facing supporting surface engaged with the land to support the circle gear; and wherein the cylinders are on the member at a level below the supporting surface.

5. The combination of claim 4 wherein each cylinder is formed in said member, and each movable wall is a piston engageable with the smooth surface of the circle gear.

6. The combination of claim 4 wherein each cylinder is formed in an insert mounted in an opening in said member.

7. The combination of claim 4 wherein: each cylinder is a hydraulic cylinder having an operating axis, said members mount the hydraulic cylinders with their operating axes extending radially of the circle gear, the drive means includes a hydraulic motor for driving the circle gear, and the last-mentioned means includes a hydraulic circuit which incorporates controls which move the cylinder walls to said one position when the hydraulic motor is not operated and to the second position when the hydraulic motor is operated.

* * * * *